United States Patent [19]

Patenaude

[11] Patent Number: 4,595,419

[45] Date of Patent: Jun. 17, 1986

[54] ULTRASONIC DECONTAMINATION ROBOT

[75] Inventor: Richard S. Patenaude, Old Saybrook, Conn.

[73] Assignee: Proto-Power Corporation

[21] Appl. No.: 453,762

[22] Filed: Dec. 27, 1982

[51] Int. Cl.[4] ..... B08B 3/12

[52] U.S. Cl. ..... 134/1; 134/18; 134/22.18; 134/24; 376/310; 901/41; 901/44

[58] Field of Search ..... 134/1, 18, 22.12, 22.18, 134/24, 56 R, 57 R, 166 R, 166 C, 184; 165/95; 376/310; 901/9, 30, 41, 44, 46

[56] References Cited

U.S. PATENT DOCUMENTS

| | | | |
|---|---|---|---|
| 3,007,814 | 11/1961 | Bulat . | |
| 3,089,790 | 5/1963 | Balamuth et al. | 134/1 |
| 3,139,101 | 6/1964 | Wyczalek et al. . | |
| 3,154,890 | 11/1964 | Lemelson . | |
| 3,166,772 | 1/1965 | Bodine, Jr. . | |
| 3,166,773 | 1/1965 | Wyczalek . | |
| 3,173,034 | 3/1965 | Dickey et al. | 134/1 X |
| 3,446,666 | 5/1969 | Bodine . | |
| 3,778,938 | 12/1973 | Korn et al. . | |
| 4,004,698 | 1/1977 | Gebelin . | |
| 4,018,345 | 4/1977 | Formanek et al. . | |
| 4,018,346 | 4/1977 | Leshem et al. . | |
| 4,103,519 | 8/1978 | Davidson | 134/1 X |
| 4,148,403 | 4/1979 | Riffe . | |
| 4,168,782 | 9/1979 | Sturges, Jr. . | |
| 4,179,035 | 12/1979 | Francois et al. . | |
| 4,219,976 | 9/1980 | Burack et al. . | |
| 4,231,696 | 11/1980 | Rieben . | |
| 4,320,528 | 3/1982 | Scharton et al. | 134/1 X |
| 4,375,991 | 3/1983 | Sachs et al. | 165/95 X |
| 4,393,920 | 7/1983 | Shima et al. | 165/11 A |
| 4,407,236 | 10/1983 | Schukei et al. | 165/95 X |
| 4,444,146 | 4/1984 | DeWitz et al. | 134/1 X |

*Primary Examiner*—Marc L. Caroff

*Attorney, Agent, or Firm*—Pasquale A. Razzano

[57] ABSTRACT

An ultrasonic decontamination robot removes radioactive contamination from the internal surface of the inlet and outlet headers, divider plate, tube sheet, and lower portions of tubes of a nuclear power plant steam generator. A programmable microprocessor controller guides the movement of a robotic arm mounted in the header manway. An ultrasonic transducer having a solvent delivery subsystem through which ultrasonic action is achieved is moved by the arm over the surfaces. A solvent recovery suction tube is positioned within the header to remove solvent therefrom while avoiding interference with the main robotic arm. The solvent composition, temperature, pressure, viscosity, and purity are controlled to optimize the ultrasonic scrubbing action. The ultrasonic transducer is controlled at a power density, frequency, and on-off mode cycle such as to optimize scrubbing action within the range of transducer-to-surface distance and solvent layer thickness selected for the particular conditions encountered. The robot is also equipped with an ultrasonic position-sensing transducer for determining standoff distance.

6 Claims, 6 Drawing Figures

ULTRASONIC DECONTAMINATION ROBOT

BACKGROUND OF THE INVENTION

This invention relates to nuclear power plant steam generators and is more particularly directed to methods and devices for removing radioactive contaminants from the internal surfaces of the primary fluid inlet and outlet headers, including the divider plate (if so fitted), the tube sheet surface exposed to the primary fluid, and portions of the primary fluid side of the tubes.

Steam generators for nuclear service are typically of either a U-tube or once-through configuration. While this invention is applicable to both, for purposes of describing this invention the U-tube type steam generator will be considered.

A typical U-tube type nuclear steam generator comprises a vertically oriented shell, a plurality of U-shaped tubes disposed in the shell so as to form a tube bundle, the tubes having two straight sections joined at their upper end by a pipe bend, a tube sheet for supporting the tubes at the ends of the tube straight section, a dividing plate that cooperates with the tube sheet forming a primary fluid inlet header at one end of the tube bundle and a primary fluid outlet header at the other end of the tube bundle, a primary fluid inlet nozzle in fluid communication with the primary fluid inlet header, and a primary fluid outlet nozzle in fluid communication with the primary fluid outlet header. The steam generator also comprises a wrapper disposed between the tube bundle and the shell to form an annular chamber adjacent the shell, and a feedwater inlet system above the pipe-bend end of the tube bundle. The primary fluid, having been heated by circulation through the reactor core, enters the steam generator through the primary fluid inlet nozzle. From there, the primary fluid is conducted into the primary fluid inlet header, through the U-tube bundle, out the primary fluid outlet header, and through the primary fluid outlet nozzle to the remainder of the reactor coolant system. At the same time, feedwater is introduced into the steam generator through the feedwater ring. The feedwater is conducted down the annular chamber adjacent the shell until the tube sheet near the bottom of the annular chamber causes the feedwater to reverse direction, and pass in heat-transfer relationship with the outside of the U-tubes and up through the inside of the wrapper. While the feedwater is circulating in heat-transfer relationship with the tube bundle, heat is transferred from the primary fluid in the tubes to the feedwater surrounding the tubes, causing a portion of the feedwater to be converted to steam. The steam then rises and is circulated through typical steam turbine electrical generating equipment to produce electricity.

Since the primary fluid contains radioactive particles and is isolated from the feedwater only by the U-tube walls, the latter serving as primary boundary for isolating these radioactive particles, it is important that the U-tubes be maintained defect-free and that no breaks occur in the U-tubes. However, experience has shown that under certain conditions the U-tubes may develop leaks therein which allow radioactive particles to contaminate the feedwater. This can present a highly undesirable and potentially dangerous condition.

Testing or inspection is required at regular intervals to determine the condition of the tubes. Such testing conducted according to standard techniques requires personnel to enter the inlet and outlet headers through the manways provided for that purpose. Deposits of radioactive particles on primary fluid wetted surfaces result in significant personnel radiation exposure rates in areas where personnel access is required. This limits the amount of time that personnel can remain in the headers, and restricts the amount of testing that each individual worker can perform.

A reduction of this radiation dose rate to some practical limit is sometimes attempted prior to testing, inspections or other work being carried out in the inlet and outlet headers.

One known method for removal of a portion of these deposits of radioactive particles on the internal surfaces of the inlet and outlet header involves impinging a high velocity stream of water against these surfaces. This cleaning process (commonly referred to as decontamination) is also known as hydroblasting, hydrolancing, or high-pressure spraying. A decontamination factor (i.e., exposure rate before cleaning divided by exposure rate after cleaning) of two can typically be expected in the header following decontamination by this method. The several shortcomings inherent in the high pressure spraying process include the relatively low decontamination factor and the high radiation exposures received by personnel involved in carrying out the cleaning process.

OBJECTS AND SUMMARY OF THE INVENTION

It is an object of this invention to provide a method and device for removing radioactive particulate material adhering to internal surfaces of steam generator inlet and outlet headers, without the drawbacks characteristic of the prior art.

It is a particular object of this invention to provide a method and device for removing radioactive particulate material adhering to internal surfaces of steam generator inlet and outlet headers by using a specialized ultrasonic transducer and a solvent conditioning and delivery system to produce and implode bubbles, thereby resulting in a concentrated shock wave at liquid-solid interfaces at said internal surfaces.

It is a more particular object of this invention to provide a method and device for removing radioactive particulate material adhering to internal surfaces of steam generator inlet and outlet headers by using a specialized ultrasonic transducer and a solvent conditioning and delivery system in conjunction with a remotely-monitored robotic arm mounted in the header manway which is guided and directed by a microprocessored-based controller.

In accordance with an object of this invention, radioactive contaminants are removed from the internal surfaces of the primary fluid inlet and outlet headers of a steam generator by means of a microprocessor-controlled (i.e., digital-computer-controlled) robotic arm fitted to the manway penetration. The robotic arm moves and positions specialized ultrasonic transducers supplied with fluid solvent to effect a thorough cleaning of the internal surfaces. A solvent processing sub-system provides for solvent filtration for removal of the radioactive particulates, fluid temperature control, and the recovery of the solvent from the component being cleaned in order to allow recycling of solvent.

The specialized ultrasonic transducers have both contours and configurations suitable for the surface to be cleaned. The ultrasonic transducers may be of two types, a larger size capable of coupling significant amounts of energy into the solvent/solid interface area where pulses of the alternating compression and rarification cycles within the solvent produce bubbles which implode at this interface effecting the surface scrubbing, and smaller, low power units which may be operated at higher or lower frequencies than the larger units and whose function is to measure the distance from the transducers to the solvent/solid interface. These transducers are contained in a housing which provides for communication of the solvent to the area to be cleaned, and provides mounting attachment for radiation detectors which provide data on the initial degree of radioactive contaminants and the progress of ultrasonic decontamination. The housing also includes an attachment to the robotic arm. This assemblage is referred to as the decontamination head and is provided in several configurations specific to the contours of the component or surface to be decontaminated. The coupling of the ultrasonic energy to the surface being cleaned is provided by the controlled flow of solvent through orifices and fluid flow paths provided in the decontamination head and contained transducers. The decontamination head is fitted with a peripheral band of cilia-like fibres of appropriate length, diameter, and resiliency, which, together with the precise surface stand-off distance control provided by the robotic controller, maintains the solvent fluid layer between the transducer and surface being cleaned to that value required for optimal cleaning.

Cleaning (decontamination), including removal of both loose and tightly adhering radioactive particulate matter from the internal surfaces of the inlet and outlet headers, is accomplished by the foregoing under direction of human operators remote from the steam generator. Any radiation exposure received by the operators is limited to the brief periods required for initial installation, transducer changes, and end-of-process system removal.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings, wherein:

DETAILED DESCRIPTION OF A PREFERRED EMBODIMENT

Figure 1:
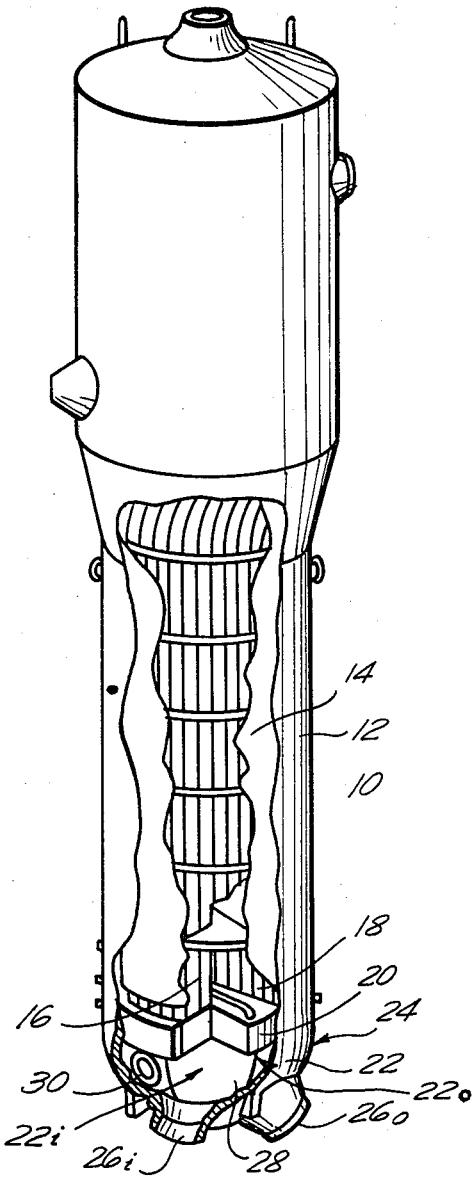
FIG. 1 is a perspective view of a U-type steam generator with portions of the header surfaces exposed.

FIG. 1 shows a U-tube type steam generator 10 as used in a nuclear power generating facility. This generator 10 has a vertically-oriented outer cylindrical shell 12 and an inner cylindrical shell 14. Disposed within the inner shell 14 is a bundle of up to 7,000 U tubes, each including an ascending tube portion 16 and a descending tube portion 18. A tube sheet 20, generally formed as a thick disc and having tube holes therein, is attached to the outer shell 12 near its lower end and supports the ascending and descending tube portions 16 and 18. A primary-fluid header 22 is formed by the tube sheet 20 and a rounded lower wall 24 of the steam generator 10.

An inlet nozzle $26_i$ and an outlet nozzle $26_o$ conduct primary fluid into the header 22 and out therefrom, with the latter being divided by a divider plate 28 into an inlet header $22_i$ and an outlet header $22_o$. All the primary fluid passes between these portions through the U-tubes 16, 18.

In operation, the primary fluid which may be water having been heated by circulation through a nuclear reactor core (not shown) enters the inlet header $22_i$ from the primary fluid inlet nozzle $26_i$, then flows into the ascending tube portions 16, to the descending tube portions 18, from there to the outlet header $22_o$, and is eventually removed through the outlet nozzle 26. The primary fluid thus cooled is recycled through the reactor core to be heated again. Secondary water is supplied into the cavity defined by the shell 12 so as to contact the U-tubes 16, 18, where the water is vaporized. The steam so generated is then supplied, for example, to a steam turbine prime mover to rotate an electric power generator.

The extreme care required for operation of a nuclear power facility demands that the tube sheet 20 and the tubes 16, 18 ascending therefrom and descending thereto be regularly inspected for cracks and leaks. For this purpose, a sealable manway 30 is provided for each of the inlet and outlet headers $22_i$ and $22_o$.

Figure 2:
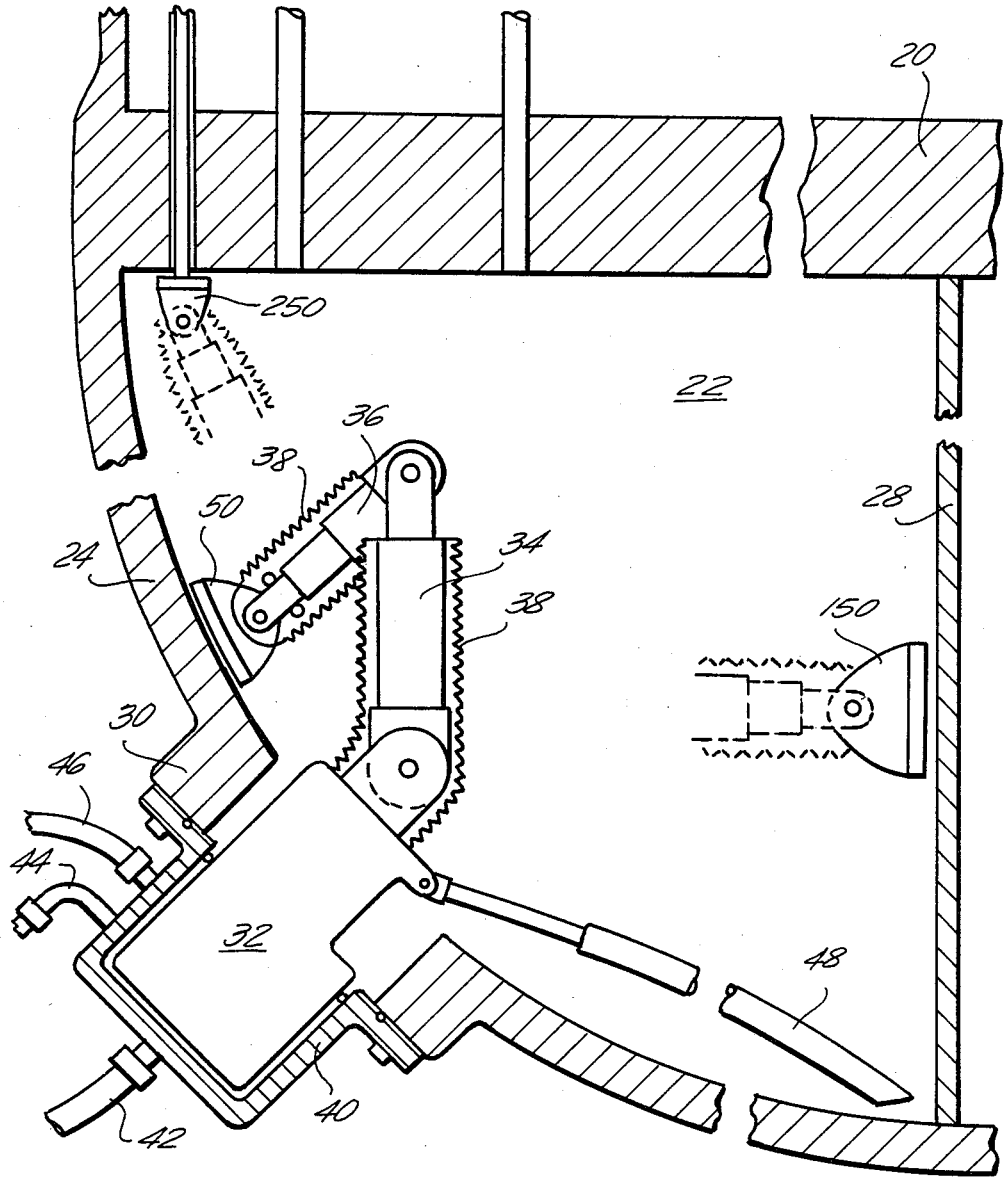
FIG. 2 is a cross-sectional elevation of a typical steam generator, showing the robotic arm of this invention in place in a manway thereof, and also showing alternative decontamination heads therefor.

When the reactor is not operating, such as during refueling, the steam generator 10 can be deactivated and drained, and the primary fluid maintained at a level such that the inlet and outlet headers $26_i$ and $26_o$ are dry. Following removal of a manway strongback and diaphragm from each of the inspection manways 30, and installation of hot leg and cold leg seals in the inlet and outlet nozzles $26_i$ and $26_o$, a cleaning robot of the type shown in FIG. 2 is installed and sealed in one of the manways 30.

The robot includes a remotely-controlled machinery module 32 dimensioned to fit within the manway 30, and lower and upper extensible articulated arms 34 and 36. Flexible elastomer sleeves 38 are disposed over the lower and upper arms 34, 36 to minimize the contact of the radioactive contaminants in the header 22 with the inner parts of the robot.

A cover 40 bolts to the manway 30 to hold the module 32 in place and to seal the robot within the header 22.

A solvent drain or outlet hose 42 conducts ultrasonic cleaning fluid from the module, while a supply hose 44 supplies pressurized fluid solvent thereto, and a control umbilical 46 contains conductors to transmit power and control signals to the module 32 and also to transmit sensor signals therefrom.

A spent-solvent suction tube 48 is connected to the module 32 and has an end disposable to a low point within the header 22 to remove fluid and loosened radioactive contaminants from the low point, where these can be expelled by the module 32 through the outlet hose 42.

An ultrasonic decontamination head 50 is removably installed on the end of the upper arm 36 for cleaning the interior surface of the spherical wall 24. Accordingly, the head 50 has a convex spherical face to match this surface. A flat decontamination head 150 and a rod-type decontamination head 250, as are schematically shown in FIG. 2, can each be installed on the arm 36 after the interior surface of the wall 24 has been cleaned to decontaminate and inspect the divider plate 28, tube sheet 20, and lower portions of tubes 16 and 18.

The remaining header is treated in a similar manner.

Figure 3:
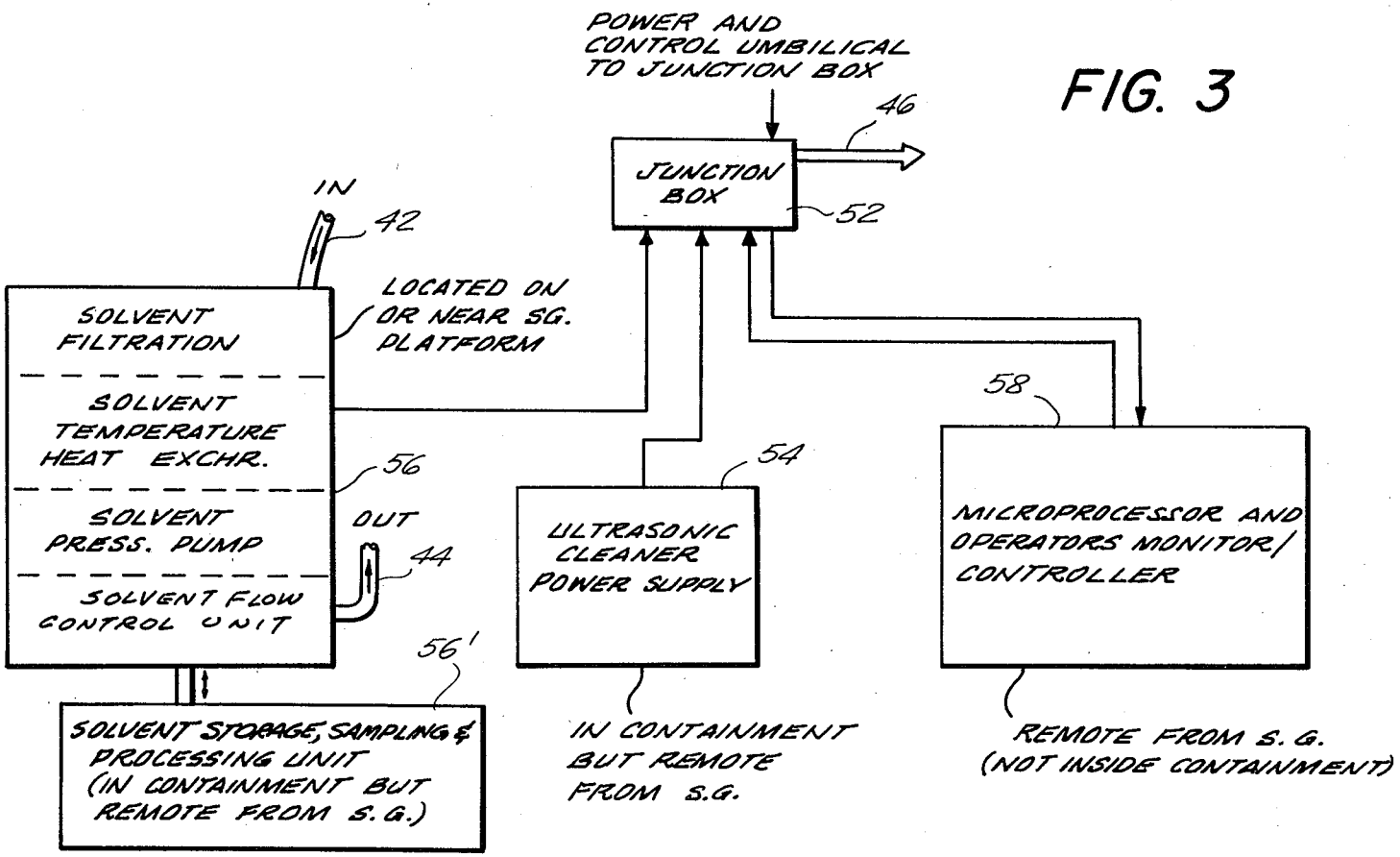
FIG. 3 is a schematic block diagram of the control and solvent processing system associated with the ultrasonic decontamination robot of this invention.

A schematic diagram of the solvent supply and robot control apparatus is shown in FIG. 3.

A junction box 52 is connected to the power and control umbilical 46 and to an ultrasonic cleaner power supply 54, a solvent processing stage 56, and a microprocessor-based operator's control console 58, the latter including a monitor and controller.

The junction box 52 is preferably located in the containment vessel near the steam generator 10. The ultrasonic cleaner power supply 54 and the solvent processing stage 56 can be located in the containment vessel remote from the steam generator, and the console 58 can be located outside the containment vessel.

The processing stage 56 includes readily replaceable solvent filtration elements, a solvent temperature heat exchanger, a solvent pressure pump, and a solvent flow control unit. The latter is connected to the solvent supply inlet tube 44 while the solvent filtration unit is connected to the solvent outlet tube 42. A solvent storage, sampling and processing unit 56' connected to the solvent processing stage 56 can be disposed in the containment vessel at a point remote from the steam generator 10 but accessible to an operator.

Figure 4:
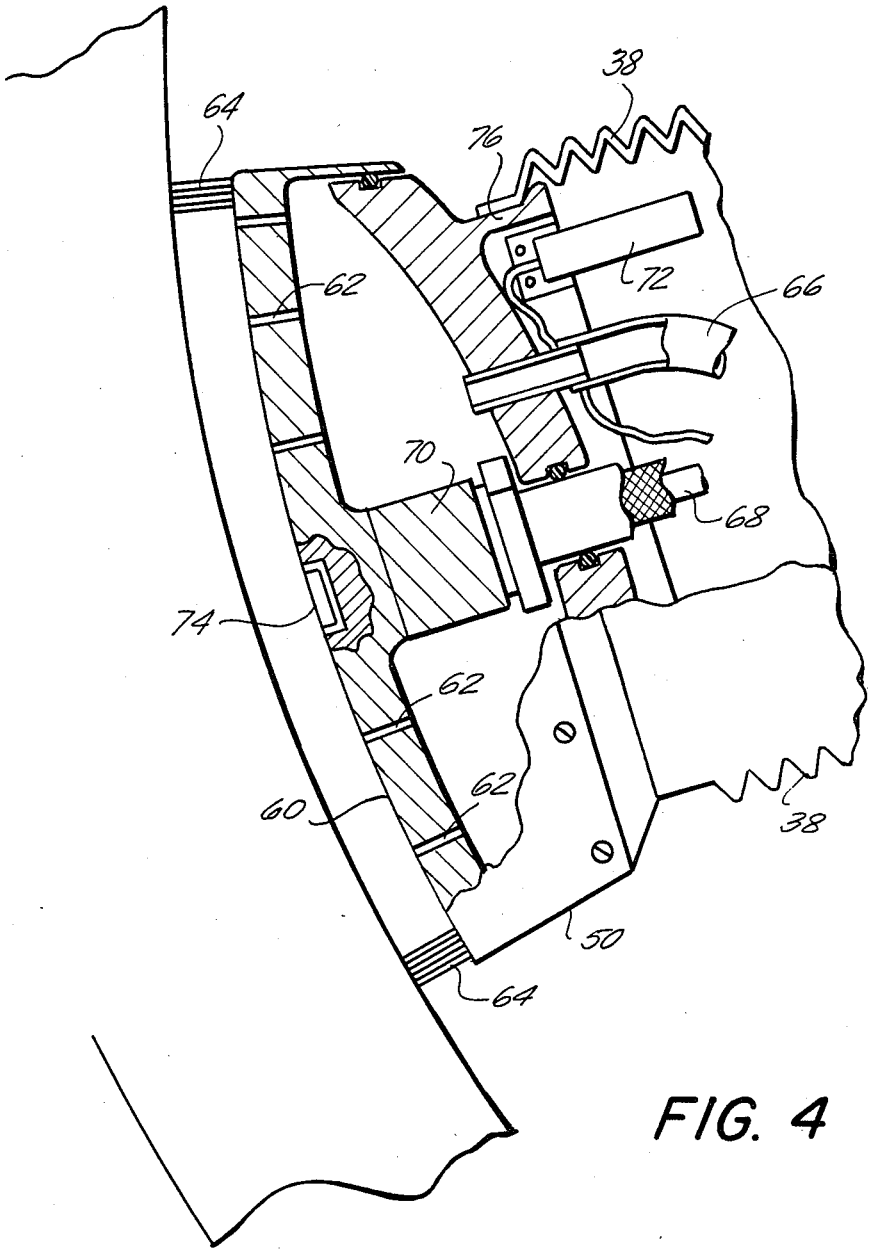
FIGS. 4, 5, and 6 are partial cross-sectional views showing details of the decontamination heads of this invention.

As shown in FIG. 4, the convex spherical decontamination head 50 has a convex spherical face 60 with solvent passages 62 extending through it. Cilia-like solvent retention fibers 64 are disposed in a circle about the perimeter of the face 60. A solvent feed hose 66 supplies the ultrasonic fluid solvent to a cavity within the head 50, and a power supply cable 68 supplies ultrasonic drive current to an ultrasonic cleaning transducer 70 within the cavity. One or more radiation detectors 72 are disposed on the back of the head and an ultrasonic position-sensing transducer 74 is located in the center of the convex face 60.

The flexible boot 38 extends over a flange 76 on the decontamination head 50 to seal off the area containing the detectors 72, cables, hoses and extensible elements of the arm 36.

The head 50 can be removably affixed to the upper arm 36 by conventional fastening means, such as a bolt or a releasable clamp.

The structure of the flat decontamination head 150 is generally the same, except that its face is flat rather than spherical.

Figure 5:
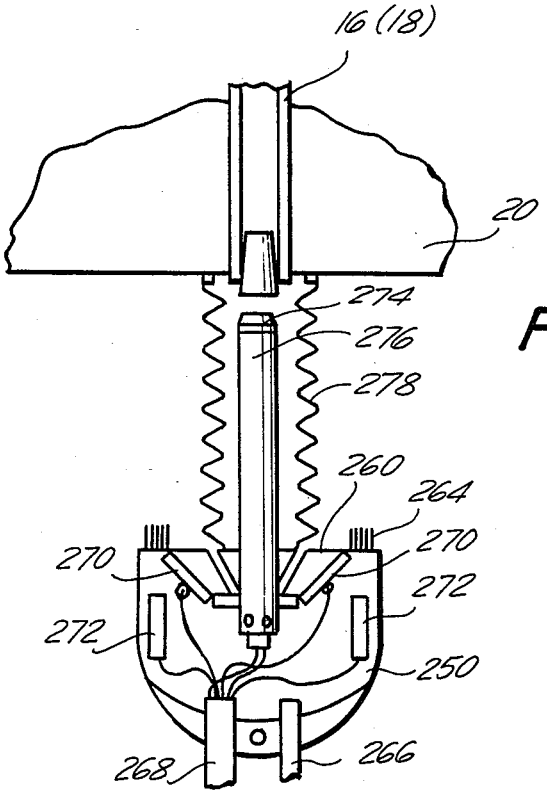
Figure 6:
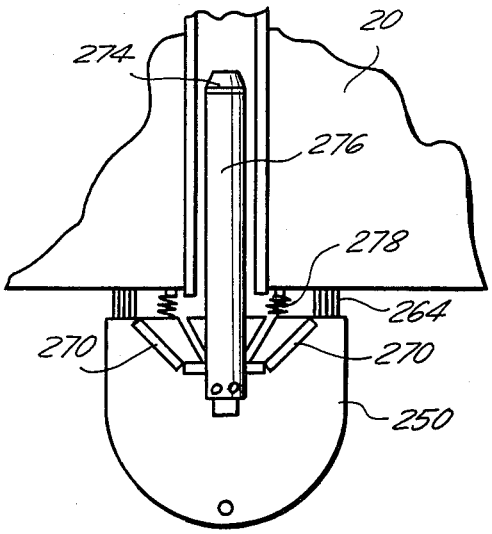

The rod-type decontamination head 250 is shown in detail in FIGS. 5 and 6, in which elements similar to those of the head 50 of FIG. 4 are identified with the same reference numbers, but raised by 200. In this head 250 cilia-like fluid retention fibers 264 surround the face 260 and ultrasonic transducers 270 are disposed therebehind. Solvent is supplied through a tube 266 and a cable 268 has conductors connected to the transducers 270, 274 and also to radiation detectors 272. A probe rod 276 which projects above the face 260 is dimensioned to fit within the tubes 16, 18. A compressible elastic boot 278 radially surrounds the probe rod 276 and has a diameter slightly larger than the diameter of the tubes 16, 18. The probe rod 276 can contain magnetostrictive, piezoelectric, gas, or hydraulic ultrasonic transducers to perform ultrasonic cleaning in, and to sense the condition of tubes 16 or 18 within the tube sheet 20.

The operation of the ultrasonic decontamination robot can be described as follows.

When the reactor is not operating, such as during refueling, the steam generator is deactivated and drained as mentioned above, and the decontamination robot is fastened and sealed to the manway 30, after having first been fitted with the convex style decontamination head 50. The solvent supply and suction hoses 46, 44 are connected, as is the control umbilical 42. The solvent processing unit 56, ultrasonic cleaner power supply 54, and operator's monitor/controller console 58 are then energized. The operator initiates a program in which the first action of the controller and robotic arm 34, 36 is to position the head 50 at a first reference point in the header 22, establishing solvent flow and advancing the head 50 towards the surface of the steam generator header 22 until a pre-selected standoff distance is detected by sensing transducer 74; then the controller 58 stops the head advance and stores the head coordinates that are fed back by the robotic arm for future use. The program proceeds through the several other reference points on each distinct surface in the header 22 gathering and recording similar data. The microprocessor program proceeds into an error analysis phase where the data obtained are compared to pre-programmed coordinates which may have been "learned" in a mock-up of the header, or calculated from dimensional data. A revised set of coordinates describing the inner surfaces and for the guidance of the decontamination head 50 over the surfaces to be cleaned may be generated from the foregoing error analysis. The next sequence performed by the controller 58 is a sweep or survey of the internal surfaces of the header with the radiation detectors 72 providing data on the type and amount of radiation emanating from these surfaces at each of several pre-programmed control points. The microprocessor/monitor panel analyses, displays and stores these data for later control purposes. These detectors 72 also provide radiation data as the decontamination operation is taking place.

Cleaning and decontamination of this largest continuous surface, i.e., the concave spherical-curvature surface of the header approximating one quarter of a sphere, may then be performed with the microprocessor controller guiding the robotic arm 34, 36, and thus the decontamination head 50 over this surface while maintaining the most effective stand off distance and sweep speed. The controller 58 may also monitor and control the various parameters of the solvent processing unit 56, 56' to effect optimum cleaning action through proper selection of solvent temperature, pressure, and flow rate and to signal the desirability of human operator intervention to adjust concentrations of solvent additives. These additives may include a wetting agent, a cleaning agent or other desirable chemicals. The controller 58 may also select an alternate filtration element, if particulate concentrations are adversely affecting cleaning action. In a similar manner, the controller 58 can monitor and control the ultrasonic power supply 54 to adjust frequency, power density, and pulse amplitude, frequency, and duration.

Data from radiation detectors 72 in the decontamination head 50 may be processed to provide the human operator with current predictions as to projected effectiveness of additional cleaning cycles, identify selected areas for additional decontamination and aid in the decisions to stop the particular cleaning phase, change the head 50 for one of the other heads 150, 250, and start a new cleaning phase.

Change-over to a flat-surface or tube-end cleaning phase is accomplished by removing the robot from the manway 30 and replacing the decontamination head 50 together with its enclosed transducers and detectors and a portion of the arm 36 containing connectors with one of the other heads 150, 250 of appropriate configuration.

Cleaning of the tube sheet 20 and tube ends may require additional data gathering utilizing a program which would first guide the rod-type decontamination head/sense transducer 250 to verify which tubes are plugged. These data could be displayed, stored, and used by the main program to modify the guidance program for decontamination of the tube sheet 20 and tube ends.

Cleaning of the flat vertical surface of the divider plate 28 and areas of the tube sheet 20 with high concentrations of plugged tubes may be accomplished in the general manner described above using the flat surface decontamination head 150.

While there has been described what is considered to be the preferred embodiment of the invention, it is to be understood that modifications and variations thereof will occur to those skilled in the art, without departing for the true spirit and scope of the present invention. For example, a robot which is fitted with more than one arm may be used, or several decontamination heads may be fitted to an arm. Alternatively, the robotic arm 34, 36 may be fitted with other devices to perform inspections or carry test probes, closed circuit television cameras, transducers, or other devices to ascertain the conditions within the steam generator header or tubes and pipes communicating therewith. Furthermore, the robot could be modified to perform work and repairs inside the header 22, for example, tube plugging or plug removal. Water jet spray nozzles may also be fitted to the end of the arm 36, which could be supplied by the aforementioned solvent supply feed hose 66 and used to perform final rinse and washdown of the surfaces which have been first cleaned by the ultrasonic cleaning devices described herein.

Furthermore, the preferred embodiment of the invention has been designed specifically to address the problems of decontamination removal of the radioactive contaminants on the inner surfaces of a steam generator header, as these deposits emit radiation and workers must be protected from exposure exceeding specified amounts. Thus, the preferred embodiment described has as its primary aim the decontamination of those surfaces from both loose and tightly-adhering radioactive material that can expose workers performing work in and near the inlet and outlet headers $22_i$, $22_o$ to significant radiation levels. The cleaning and decontaminating system described, with its precise monitoring of all the significant variables which govern the efficiency and effectiveness of the ultrasonic cleaning/decontamination process and its inherently responsive control mechanisms, ensures that the highest possible decontamination factors are achieved, these being in the range of 10 to 100 depending upon initial conditions of the header surfaces, water chemistry of the previous operating periods, sources of contaminants, fuel leakage, and other familiar factors.

The robotic arm 36 can also be fitted with testing devices to perform inspection functions and to ascertain the conditions within the headers $22_o$ and $22_i$. devices can include eddy current testing probes, ultrasonic testing probes, closed-circuit television cameras and associated lighting devices, fiber-optics flexible borescope direct viewing subsystems, and profilometer equipment. In this case, the robotic arm would be programmed to perform the task of placing or moving an inspection device or measuring tool which is then interpreted by the human operator, either directly or after processing of the gathered data by the digital computer. The robotic arm could perform this tool movement and precision placement more rapidly than a human operator and also avoid unnecessary radiation exposure.

The robotic arm 36 can also be fitted with manipulative devices and tools to perform repair and/or maintenance functions or modification work inside the headers $22_o$, $22_i$. For example, tools can be attached to grind, chip, weld, or drill inside the header $22_o$ or $22_i$ to avoid human exposure to radiation when these tasks are necessary. For automatic (robotic) welding, a device can be attached for gas cup and wire delivery to be used in connection with an electric welder. Tube plugging and tube plug removal can also be carried out automatically by devices attached to the arm 36.

Still further, the programmable robotic device of this invention can be configured to carry out cleaning, inspection, and repair functions while completely submerged in a suitable fluid inside the header. Such a fluid could serve to enhance the decontamination process, provide additional radiation attenuation, and permit simulataneous work to be carried out on other portions of the steam generator which can be enhanced by pressure balancing.

Many further modifications and variations of the above described device and process will be apparent to those of skill in the art without departure from the scope and spirit of this invention, as defined in the appended claims.

What is claimed is:

1. A method of removing radioactive contamination from a primary fluid header of a steam generator between periods of active operation thereof, the header having a sealable access manway therein to permit access to interior surfaces of the header, comprising the steps of inserting through the header manway into the interior thereof a robotic arm having a base portion sized to fit sealably in said manway, an ultrasonic decontamination head disposed to be movable at an end of said robotic arm, a solvent supply tube connected to said decontamination head, and a fluid removal conduit disposed at a low point in the interior of said header;

sealing said base portion in said header manway;

connecting a remotely positioned solvent processing device to said supply tube and said fluid removal conduit; and connecting a remotely positioned robotic controller to said robotic arm to supply ultrasonic power to said ultrasonic decontamination head and to supply position signals to said robotic arm to position the ultrasonic decontamination head against at least one of said surfaces while fluid solvent is supplied through said supply tube to said head and said ultrasonic decontamination head produces ultrasonic acoustic waves such that any radioactive surface contaminants are loosened and flushed from said at least one surface and the loosened contaminants in said fluid solvent are removed from said interior by said fluid removal conduit and transferred to said solvent processing device, said ultrasonic decontamination head further generating, in addition to said ultrasonic acoustic waves for loosening surface contaminants, additional ultrasonic waves for sensing distance of said head from an interior surface of said header, and sensing said additional ultrasonic waves with a sensor in said head; and the method further comprising determining a standoff distance of said head from said surface based on the sensed ultrasonic waves.

2. The method according to claim 1, further comprising the step of sensing radiation intensity of said surface with radiation detector in said head, and monitoring the amount and type of radiation on said interior surface as a cleaning cycle of said ultrasonic decontamination head is taking place.

3. The method according to claim 2, further comprising automatically calculating, by means of a digital computer system, said stand-off distance for said decontamination head and radiation information; and altering solvent composition, solvent temperature, solvent pressure, solvent flow rate, and relative cleanliness with respect to particulate concentrations suspended therein to maximize cleaning efficiency.

4. The method according to claim 3, further comprising automatically controlling the frequency, power density, pulse amplitude, and duration of the ultrasonic power supplied to said decontamination head and automatically controlling the standoff distance of said decontamination head.

5. The method according to claim 1, further comprising filling said header with a liquid to submerge said robotic arm, and carrying out operation of said ultrasonic decontamination head while submerged in said liquid.

6. The method according to claim 5, wherein said liquid comprises said fluid solvent.

* * * * *